US007559198B2

(12) United States Patent
Messersi'

(10) Patent No.: US 7,559,198 B2
(45) Date of Patent: Jul. 14, 2009

(54) COOLING DEVICE FOR THE HYDRAULIC FLUID OF A SITE MACHINE HYDROSTATIC DRIVE

(75) Inventor: Fabio Messersi', Senigallia (IT)

(73) Assignee: Messersi' S.P.A., Osimo (AN) (IT)

( * ) Notice: Subject to any disclaimer, the term of this patent is extended or adjusted under 35 U.S.C. 154(b) by 394 days.

(21) Appl. No.: 11/496,465

(22) Filed: Aug. 1, 2006

(65) Prior Publication Data

US 2007/0028609 A1 Feb. 8, 2007

(30) Foreign Application Priority Data

Aug. 4, 2005 (IT) ..... AN2005A0041

(51) Int. Cl.
*F16H 57/04* (2006.01)
*F01B 3/00* (2006.01)

(52) U.S. Cl. ..... 60/456; 417/372

(58) Field of Classification Search ..... 60/456; 417/372
See application file for complete search history.

(56) References Cited

U.S. PATENT DOCUMENTS

| | | | | |
|---|---|---|---|---|
| 3,487,431 | A * | 12/1969 | Forkner | 604/456 |
| 5,975,257 | A * | 11/1999 | Roach | 60/456 |
| 6,427,442 | B2 * | 8/2002 | Thoma et al. | 60/456 |
| 2005/0220637 | A1 * | 10/2005 | Kopel et al. | 92/12.2 |
| 2006/0090639 | A1 * | 5/2006 | Dong et al. | 91/505 |

* cited by examiner

*Primary Examiner*—Thomas E Lazo
(74) *Attorney, Agent, or Firm*—Browdy and Neimark, P.L.L.C.

(57) ABSTRACT

A cooling device for the hydraulic fluid of a site machine hydrostatic drive comprises a pump body and a rotor with vanes, keyed directly on a driving shaft which drives the pump, and driven in rotation in a way designed to send a flow of cooling air onto the pump body.

9 Claims, 5 Drawing Sheets

COOLING DEVICE FOR THE HYDRAULIC FLUID OF A SITE MACHINE HYDROSTATIC DRIVE

BACKGROUND OF THE INVENTION

The present invention relates to the technical sector of small self-propelled machines for building sites, having hydrostatic drives.

In the site machines sector the heat developed by the hydrostatic drive during machine use is normally disposed of using heat exchangers, or radiators, mounted on the hydrostatic system itself and ventilated by ventilation means which may or may not be driven electrically by the service apparatuses with which the machine is usually equipped.

In machines of more simple construction which do not have electrical, ignition and service systems, in which the engine is started by a manual pull starter, such cooling is achieved by means of fans which operate in such a way that the outside of the pump body is struck by a flow of suitably accelerated air which produces forced convection against the pump body, which helps to cool the drive oil contained in it and/or passing through the pump body.

The first type of said solutions can be applied to machines with a medium high technological level and a corresponding price band. Obviously, the machine must have an electrical ignition system which can supply the electricity for accessory services provided in addition to the basic machine functions. Obviously, this already involves a certain basic cost of the machine which is not negligible. The machine must also be fitted with the exchanger and/or radiator with the ventilation means used by it, which contribute to a further rise in the overall price band of the machine.

In contrast, the second type of solution is characteristic of smaller, less expensive machines, and/or relatively low-powered machines in which the machine structure is designed in such a way as to keep the machine costs at the lowest possible values by excluding all apparatuses—for example the electrical ignition system—which are not strictly necessary to the minimum basic functions of the machine.

In this latter construction approach—which represents the prior art most relevant to the present invention—an embodiment is already known which involves the use of a fan for the pump body, which—with reference to the direction of travel of the vehicle—is located behind the internal combustion engine in the machine. The rotation of the fan is driven by a shaft driven by a mechanical belt drive which, in turn, is operated by the mechanical drive control which allows machine motion relative to the ground to be switched on or off.

However, such a solution, although spread with a certain degree of success on the market, is not without disadvantages.

Firstly, positioning the fan behind the engine means that the fan produces a ventilation flow with reduced cooling efficiency. The flow produced is subject to two heating effects, one because around the internal combustion engine the air is heated by the heat of the engine, and the other because the air passing from behind the engine towards the pump in front is inevitably forced to go through a zone directly influenced by the engine, and is further heated.

Another disadvantage is the fact that the ventilation system operates only when the vehicle is moving. In other words, when the vehicle is stationary, even with the internal combustion engine switched on, and therefore when the cooling effect of the wind from travel is completely absent, the cooling system of the hydraulic circuit cannot operate; that is to say, paradoxically, it does not operate precisely when it is most needed.

Another disadvantage is the presence of a mechanical drive inserted between the mechanical movement control and the ventilation system; a drive which, however simple, involves the presence of mechanical parts which have a negative effect on costs and the presence of interposed mechanisms, involving mechanical performance having a negative effect on the energy efficiency of the machine as a whole.

SUMMARY OF THE INVENTION

The main aim of the present invention is to overcome these disadvantages with a machine in which operation of the ventilation system is continuous and independent of the movement of the machine relative to the ground.

Another aim of the invention is to provide a ventilation system which is directly applied to the driving part of the hydrostatic drive pump for maximum simplification of the construction and to eliminate energy losses due to drive mechanism chain performance, on one hand reducing product costs and on the other hand increasing product energy efficiency.

Yet another aim of the invention is to provide a ventilation system located between the internal combustion engine and the hydrostatic drive pump so that it is less sensitive to—that is to say, more easily shielded from—the heat generated by the combustion process in the engine.

Another aim of the invention is to provide a ventilation system which can operate not only on the pump body, but also on other important accessories which are components of the hydrostatic drive or of the hydraulic system with which the operating apparatuses are equipped, therefore increasing the effectiveness of the cooling which can be extended to other parts of the machine, that is to say, to the operating parts for which prior art machines do not have any hydraulic fluid cooling system.

BRIEF DESCRIPTION OF THE DRAWINGS

The technical characteristics of the present invention, in accordance with the afore-said aims are clear from the content of the claims herein, in particular claim 1 and any claim directly or indirectly dependent on claim 1.

The advantages of the present invention are more apparent from the detailed description which follows, with reference to the accompanying drawings which illustrate preferred, non-limiting embodiments of the invention, in which.

DESCRIPTION OF THE PREFERRED EMBODIMENTS

Figure 2:
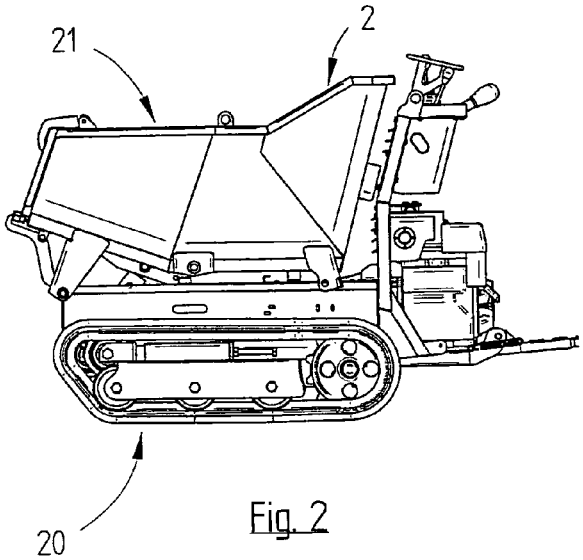
FIGS. 2 and 3 are respectively a side elevation view and a front view of the machine from FIG. 1.
Figure 3:
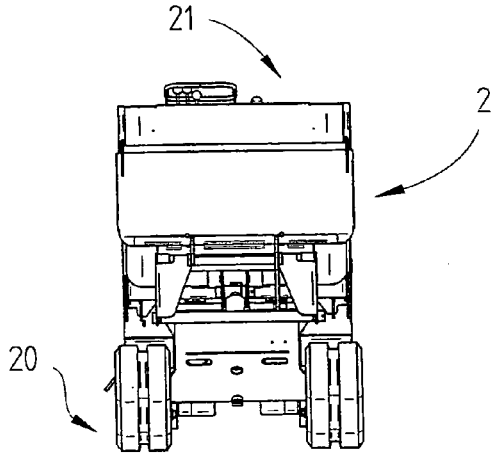
Figure 1:
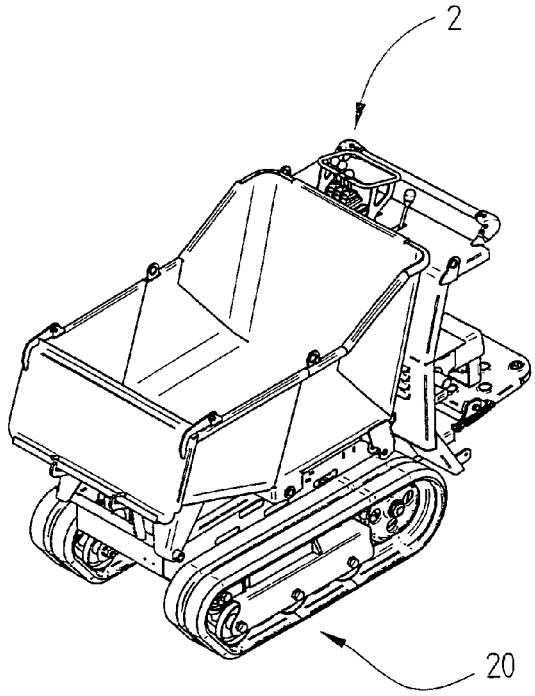
FIG. 1 is a perspective assembly view of a site machine equipped with a device made in accordance with the present invention.

With reference to FIGS. 1, 2 and 3 in the accompanying drawings, the numeral 2 denotes as a whole a small site machine 2 preferably with manual mechanical starting, equipped with tracked propulsion means 20 driven by a conventional hydrostatic drive powered by an equally conventional internal combustion engine 6.

Figure 5:
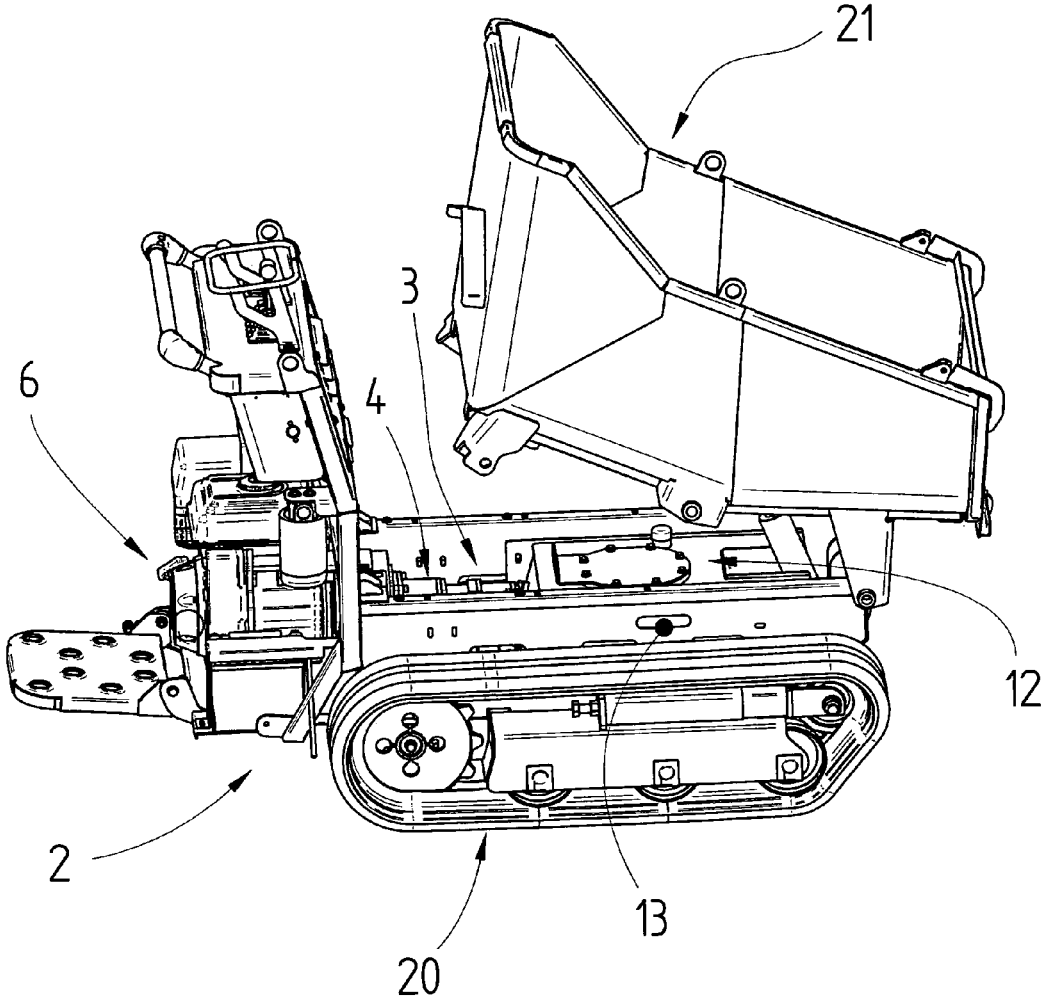
FIG. 5 is an assembly view of the machine illustrated with its working equipment in a particular configuration.
Figure 6:
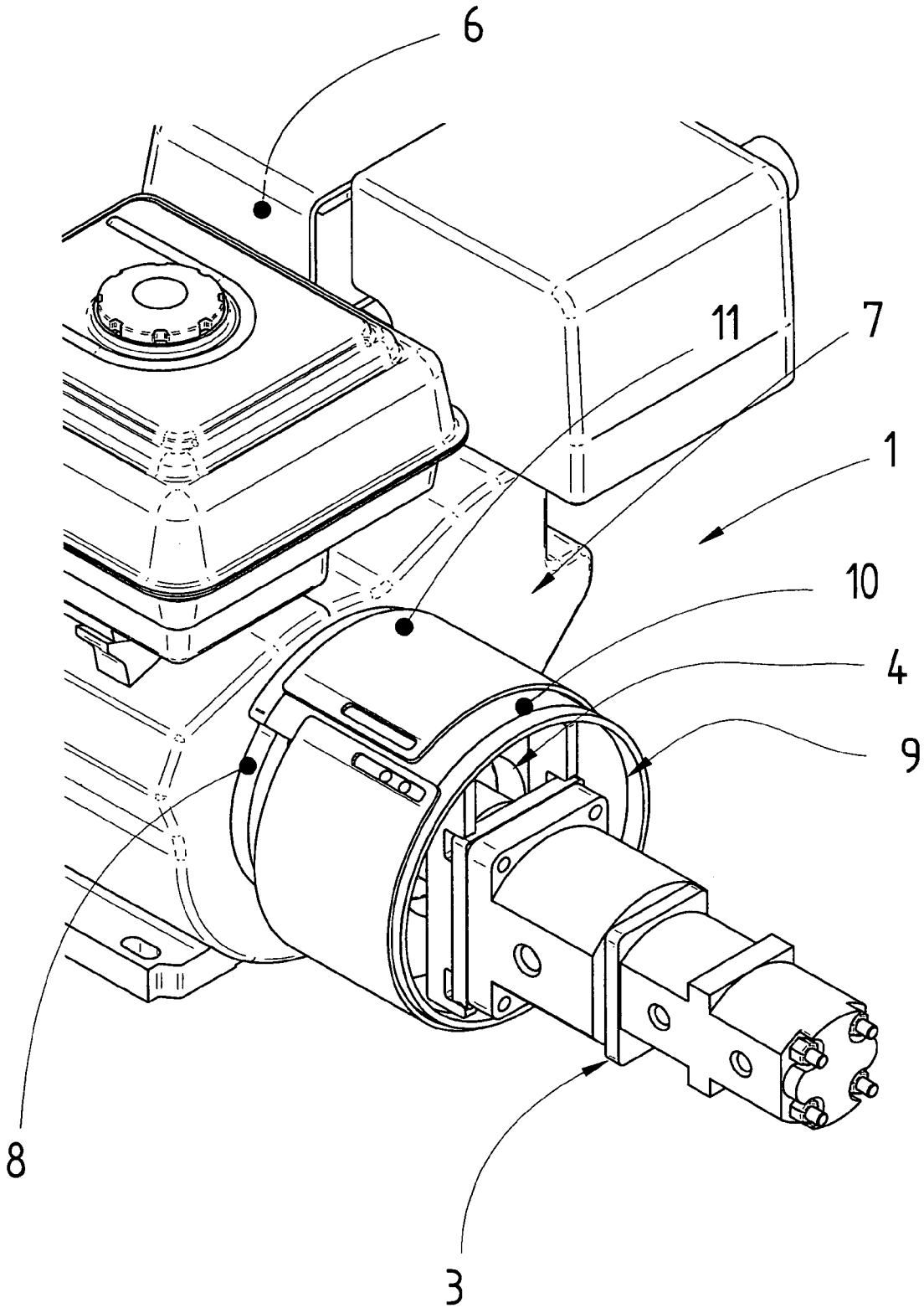
FIGS. 6 and 7 are respectively a perspective assembly view of the device in accordance with the invention and a cross-section of the device.
Figure 7:
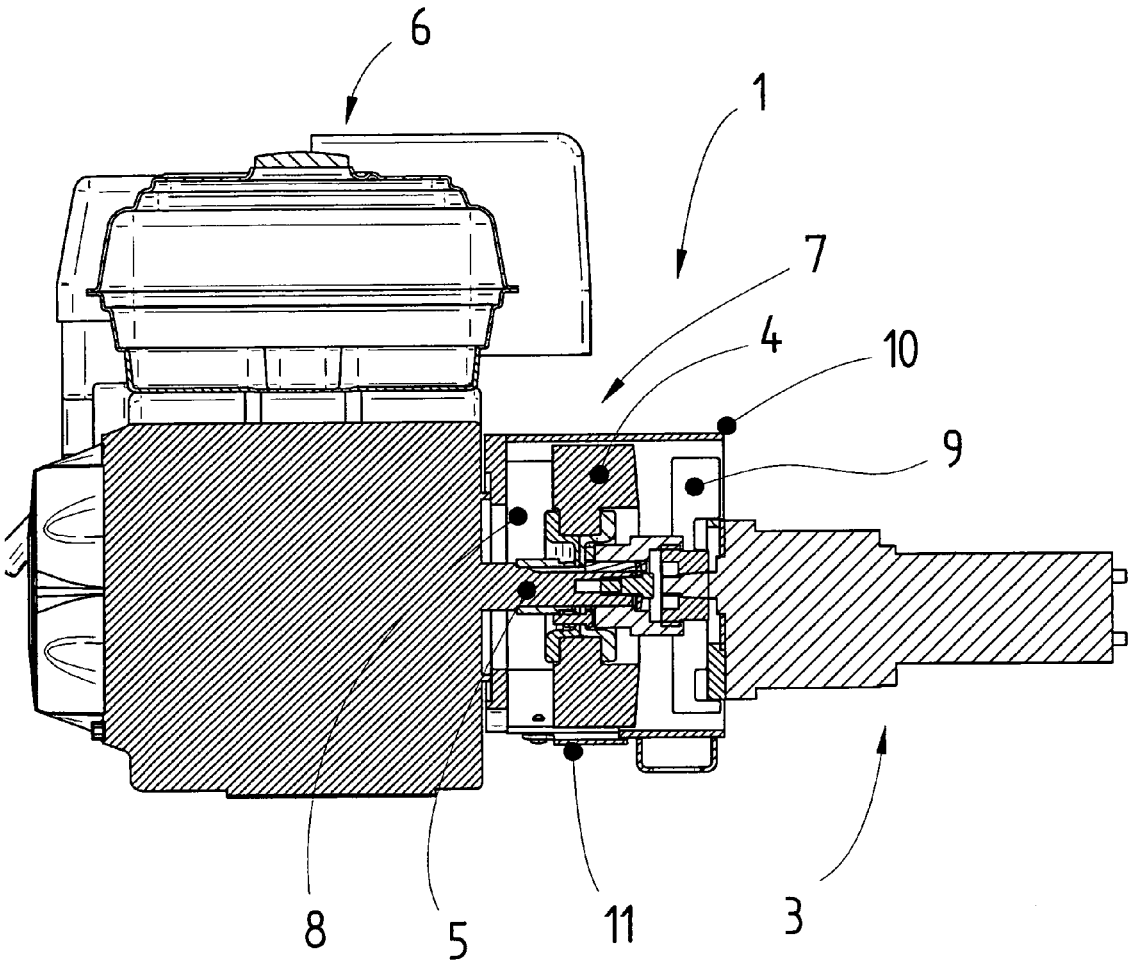

FIG. 5 and even more clearly FIGS. 6 and 7, show that the hydrostatic drive has a pump body 3 which processes in the conventional way the hydraulic fluid in the drive so as to give the tracks 20 a suitable movement relative to the ground.

As illustrated in FIG. 5 and even more clearly in FIGS. 6 and 7, the pump body 3 is angled towards the working equipment 21 which, in the case in question, is represented by way of example only and without limiting the scope of the invention, by a dump body.

Connected to the pump body 3 there is a rotor 4 with vanes, driven in continuous rotation so as to send onto the pump body 3 a constant flow of cooling air which strikes the outside of the pump body 3.

As is clearly shown in FIG. 7, the rotor 4 is keyed directly on a driving shaft 5 which forms the pump 3 actuator element.

The rotor 4 connected to the pump body 3, as described above and moved continuously by the engine 6, is part of a ventilating cooling device 1 which operates continuously whether or not the machine 2 is moving over the ground or is stationary although with the engine 6 on.

It should also be noticed that the direct connection of the rotor 4 to the driving shaft 5 of the pump 3 belonging to the hydrostatic drive allows a solution which in mechanical terms is very simple and has a very small impact on the overall cost of the machine 2. In particular, it is appreciable in low cost machines such as those with mechanical manual pull starting.

The direct transmission is also appreciable thanks to the maximum energy efficiency, since there are no energy losses ascribable to the performance of drives otherwise present in prior art solutions.

As shown in FIGS. 6 and 7, the rotor 4 is located in a position in which it is in front of—with reference to the machine 2 direction of movement—the machine 2 engine 6. In this way, the air flow conveyed towards the pump body 3 is not forced to follow a path which cannot avoid being heated by the heat from the combustion process.

Indeed, the air which reaches the rotor 4 can advantageously be drawn in from the side of the engine 6 and, when the machine is moving relative to the ground, it can be drawn in from a much less hot zone of the air surrounding the engine 6.

It should also be noticed that the air which reaches the rotor 4 does not have to pass, along its path, the area of influence of the heat from the internal combustion engine 6.

On the other hand, the cooling device 1 may also be fitted with a flow pipe 7 with the dual purpose of allowing the air intake to be directed, drawing air in from the coolest place. The flow pipe 7 also forms a duct around the rotor 4, allowing optimized management of the fluid dynamics of the cooling air passing through it, to allow simultaneously maximum cooling efficiency with minimum use of the energy resources made available by the engine 6.

It must be emphasized that the rotor 4, of the intake type, ducted, preferably integrated in the machine 2 structure, has a particularly high level of fluid dynamic efficiency as a result of a high flow rate and a high speed of air processed.

FIG. 7 shows how the flow pipe 7 which conveys the cooling flow towards the pump body 3 has one or more inlet sections 8 and one outlet section 9 for the air, the former one (or more) of which has the air pass through it in a direction radial to the rotor 4 and centripetal, whilst the latter has air pass through it in a direction axial to the rotor 4, and designed to strike the pump body 3 located further forward.

The ventilation device 1 also comprises means for regulating the flow which travels along the flow pipe 7.

Said regulating means are advantageously connected to the inlet section 8 of the flow pipe 7, where their production is more simple and economical.

In a preferred, non-limiting embodiment, the flow pipe 7 comprises, for this purpose, a first tubular body 10 which forms a duct around the rotor 4 and a second tubular body 11 which circumscribes the first tubular body 10, so that together with the latter it delimits the inlet section 8 for the air towards the inside of the flow pipe 7.

The tubular shape of the first and second bodies 10 and 11 advantageously allows the inlet section 8 to take the form of one or more air transit ports, substantially extending along a circular arc of the flow pipe 7.

The second tubular body 11 is guided on the first tubular body 10 so as to give the air inlet section 8, that is to say the port, a passage section with a size which varies according to requirements.

Figure 4:
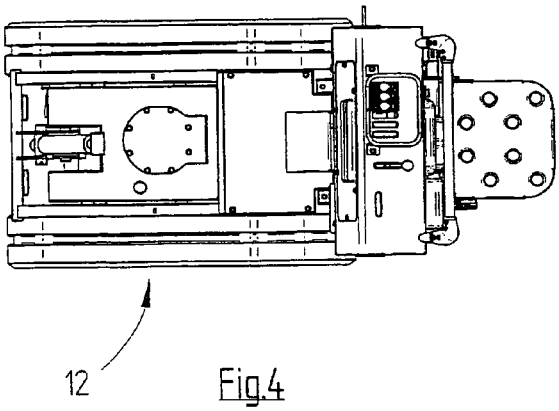
FIG. 4 is a view of an undercarriage belonging to the machine in FIG. 1, with some parts cut away to better illustrate certain details of interest.

FIG. 4 shows how the machine 2 in the accompanying drawings has an undercarriage structure 12 which is substantially tub-shaped, and which houses hydraulic components of the machine 2 operating apparatus, for example tubes, valves, actuator pistons for the working equipment 21 and the oil tank.

In this case advantageously the flow pipe 7 is connected to the undercarriage structure 12, abutting with one end of the tub so as to ventilate the components contained in it. This would not strictly be necessary when the working equipment 21 is raised off the undercarriage structure 12, as illustrated in FIG. 5, but such a construction solution proves particularly useful during the working or transfer steps in which the machine 2 is in the configurations shown in FIGS. 1, 2 and 3 with the body lowered on top of and substantially closing the undercarriage structure 12.

If the undercarriage structure 12 has outflow openings 13 angled outwards and in front of the cooling device 1, the ventilation air introduced by the flow pipe 7 travels through the entire undercarriage structure 12, that is to say the relative tub, with the advantage of extending the benefits of cooling to all of the parts contained in the undercarriage structure 12.

Figure 8:
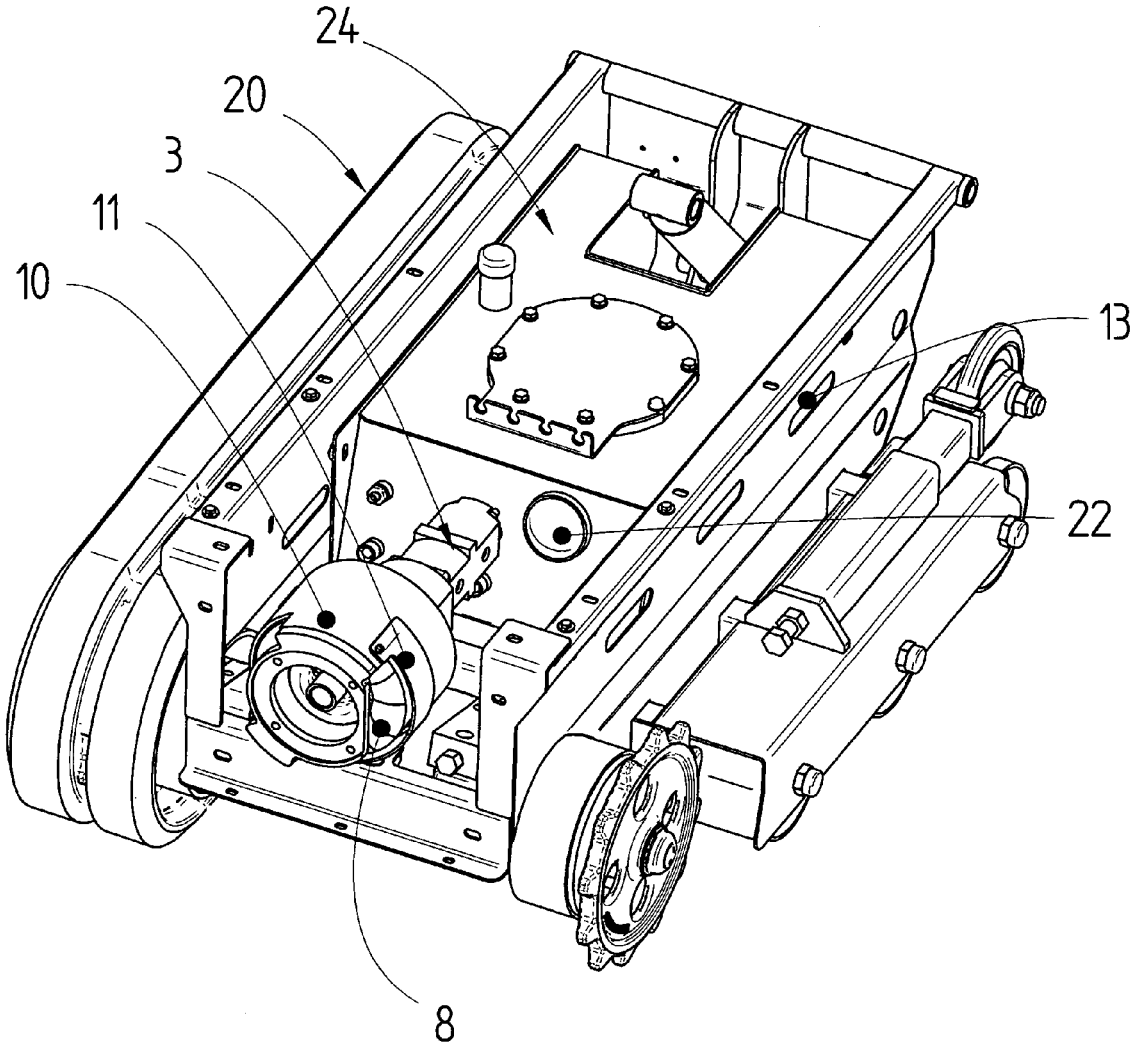
FIG. 8 is a perspective assembly view of the structure of the undercarriage from FIG. 4 with some parts cut away to better illustrate others.

With regard to this, it should be noticed that FIG. 8 shows how the oil tank 24 may also advantageously have one or more through-pipes 22, through which the air sent into the undercarriage structure 12 by the ventilation device 1 passes. This helps significantly to lower the temperature of the oil contained in it.

The invention described has evident industrial applications and may be modified and adapted without thereby departing from the scope of the inventive concept. Moreover, all details of the invention may be substituted by technically equivalent elements.

What is claimed is:

1. A cooling device for the hydraulic fluid of a site machine hydrostatic drive comprising:

a pump body and a rotor with vanes, driven in rotation so as to send a flow of cooling air onto the pump body, wherein the rotor is keyed directly on a driving shaft which directly drives the pump;

wherein, with reference to the direction of movement of the machine, the rotor is located in a position such that it is in front of a machine engine; and wherein the rotor is ducted in a flow pipe shaped in such a way that it conveys the cooling flow onto the pump body.

2. The device according to claim 1, wherein the flow pipe has an inlet section and at least one outlet section for the air, the former having air pass through it in a direction radial to the rotor, the latter having air pass through it in a direction axial to the rotor.

3. The device according to claim 2, comprising means for regulating the flow passing along the flow pipe.

4. The device according to claim 3, wherein the means for regulating the flow are connected to the inlet section of the flow pipe.

5. The device according to claim 1, wherein the flow pipe comprises a first tubular body which forms a duct around the rotor and a second tubular body which circumscribes the first tubular body, together with it delimiting an inlet section for the air into the flow pipe.

6. The device according to claim 5, wherein the second tubular body is guided on the first tubular body in such a way as to give the air inlet section a passage section with a variable size.

7. The device according to claim 1, wherein the machine has an undercarriage structure which is substantially tub-shaped, housing hydraulic components of the machine working apparatus, wherein the flow pipe is connected to the undercarriage structure in such a way that it ventilates the components contained in it.

8. The device according to claim 7, wherein the undercarriage structure has outflow openings towards the outside for the ventilation air introduced into the undercarriage structure by the flow pipe.

9. The device according to claim 8, comprising at least one through-pipe passing through an oil tank connected to the undercarriage structure.

* * * * *